US007587784B2

(12) United States Patent
Duncan et al.

(10) Patent No.: US 7,587,784 B2
(45) Date of Patent: Sep. 15, 2009

(54) MOPPING TROLLEYS

(75) Inventors: Christopher Robert Duncan, Somerset (GB); Michael Edward Gailes, Dorset (GB)

(73) Assignee: Numatic International Limited, Surry (GB)

( * ) Notice: Subject to any disclaimer, the term of this patent is extended or adjusted under 35 U.S.C. 154(b) by 454 days.

(21) Appl. No.: 10/510,462

(22) PCT Filed: Apr. 9, 2003

(86) PCT No.: PCT/GB03/01527

§ 371 (c)(1),
(2), (4) Date: Aug. 10, 2005

(87) PCT Pub. No.: WO03/086166

PCT Pub. Date: Oct. 23, 2003

(65) Prior Publication Data

US 2006/0010637 A1 Jan. 19, 2006

(30) Foreign Application Priority Data

Apr. 10, 2002 (GB) ..... 0208274.1

(51) Int. Cl.
*A47L 13/59* (2006.01)

(52) U.S. Cl. ..... 15/261; 15/264

(58) Field of Classification Search ..... 15/261, 15/264, 262, 263, 260
See application file for complete search history.

(56) References Cited

U.S. PATENT DOCUMENTS

| | | | | |
|---|---|---|---|---|
| 1,767,840 | A | 6/1930 | Finnell | |
| 2,397,707 | A * | 4/1946 | Travis | 15/50.1 |
| 3,504,392 | A * | 4/1970 | Baek | 15/260 |
| 5,440,778 | A * | 8/1995 | De Guzman | 15/260 |
| 7,225,499 | B1 * | 6/2007 | Duncan et al. | 15/261 |
| 2004/0237243 | A1 * | 12/2004 | Dahl | 15/261 |
| 2006/0010637 | A1 * | 1/2006 | Duncan et al. | 15/261 |

FOREIGN PATENT DOCUMENTS

| | | |
|---|---|---|
| DE | 43 20 454 A | 12/1994 |
| EP | 0 645 297 A | 3/1995 |
| EP | 0 801 925 A | 10/1997 |
| EP | 0 910 983 A | 4/1999 |

* cited by examiner

*Primary Examiner*—Lee D Wilson
(74) *Attorney, Agent, or Firm*—Woodard, Emhardt, Moriatry, McNett & Henry LLP

(57) ABSTRACT

A mopping trolley having a carriage, a mop press assembly with a discharge port, a clean receptacle for providing a source of clean liquid for mopping, and a waste receptacle for receiving waste liquid expressed from the mop press. The clean receptacle is located under the mop press so that a mop head may be dipped into the clean receptacle and lifted directly upward to the mop press, the mop head being maintained over the clean receptacle so that dripping excess fluid falls back to the clean receptacle below. In this way the amount of clean water wasted may be reduced, so that water dripping from the mop head falls back into the clean receptacle. The waste receptacle includes a portion that is positioned below the discharge port of the mop press assembly to receive waste liquid.

20 Claims, 4 Drawing Sheets

21
10
22
21
27
100
101
20
28
25
22
22
23
23
24
24
26

MOPPING TROLLEYS

This invention relates to mopping trolleys and has particular reference to mopping trolleys for facilitating the cleaning of a floor area using a mop. In a typical floor cleaning operation using a mop, the floor is first wetted with water or with a cleaning liquid and is then mopped dry. In the drying operation, the mop is wrung out or squeezed in order to remove surplus water, and is then passed over the floor to take up and absorb the surplus water to dry the floor. This operation can continue until the mop has become relatively saturated and is unable effectively to absorb water or liquid. At this stage the mop is again squeezed to express surplus water and the mopping operation is repeated.

A typical mopping trolley comprises a wheeled carriage carrying a bucket with a mop press disposed over the bucket which press is provided with lever means to squeeze a mop head inserted in the press and to express surplus water into the bucket. Our co-pending PCT Application No. GB00/01688 describes an improved mop press which comprises first pressing means, second pressing means and distortion means carried by at least one of pressing means characterised that in use, with a mop head inserted between the pressing means, the first and second pressing means are brought together to squeeze the mop head, the arrangement being such that the distortion means in contact with the mop head distorts in response to the uneven distribution of the mop head within the press to permit pressure to be applied more uniformly over the surface of the mop head whereby a substantial, proportion of the liquid contained within the mop head is expressed irrespective of the type and size of the mop head and without needing to adjust the relative spacing between said first and second pressing means.

This co-pending application referred to above is concerned with the problem of how to express as much water as possible from the mop head during each "squeezing" operation. In using mopping systems of the type described above, however, the operative usually wets the floor using the waste water previously expressed into the bucket. While this has been a common practice for many years, the fact remains that it is more effective to clean a floor with clean water or cleaning fluid than it is using water or cleaning fluid that has already been used.

In order to overcome this problem, it is possible to have a two bucket system in which the two buckets are mounted in juxtaposition on a mopping trolley. The press is located over a waste water bucket to allow expressed waste water to fall into that bucket. The other bucket provides a supply of clean water.

In DE 4320454A there is disclosed a trolley for commercial cleaning comprising a frame with castors, a vertical press and two buckets in the form of rectangular boxes.

It is an object of the present invention to increase cleaning efficiency by reducing the frequency with which an operative must return to a clean liquid replenishment station to charge the clean receptacle.

According to one aspect of the present invention there is provided a mopping trolley comprising carriage means capable of translational movement over a surface, a mop press assembly carried by said carriage means for expressing liquid from a mop head inserted into the press and at least two liquid receptacles, wherein a waste receptacle is arranged to receive waste liquid expressed from the mop head, and a clean receptacle is for providing a source of clean liquid for use in mopping, wherein the clean receptacle is located under the mop press and the waste receptacle is in fluid communication with a discharge port from the mop press, whereby liquid expressed from the mop head is conveyed to the waste receptacle.

In this way, clean liquid is available for mopping, and waste liquid expressed from the mop head is directed away to a separate waste receptacle. The receptacles will typically be buckets, but could be other containers for liquid. The liquid will typically be water and a detergent or other cleaning agent. A mop head may be dipped into the clean receptacle to be charged with clean liquid and lifted from the clean receptacle directly to the mop press for removal of excess charged fluid, the mop head being maintained over the clean receptacle so that dripping excess fluid falls back to the clean receptacle below. In this way the amount of clean water wasted may be reduced, so that water dripping from the mop head falls back into the clean receptacle, rather than being conveyed to the waste receptacle before being used for cleaning. As less clean liquid is wasted, the efficiency of the cleaning process is improved as fewer returns to the liquid replenishment station are necessary. The waste water is automatically diverted to the waste bucket, even though the press is not located above the waste bucket. The fluid communication is preferably achieved by gravity feed. There may also be a liquid collector projecting from the waste bucket for catching fluid draining from the mop press.

Preferably the clean receptacle has a greater volumetric capacity than the waste receptacle. Typically the clean receptacle has a capacity that is at least 40% greater than the waste receptacle. In preferred embodiments of the invention, the clean receptacle has a capacity that is at least 50% greater than the waste receptacle. We have found that by using, in a mopping trolley, buckets of dissimilar size, the efficiency of the mopping operation for a given size of trolley may be substantially improved.

In one embodiment of the trolley the waste and clean receptacles are located on the trolley in a side-by-side arrangement so that the receptacles occupy a front region of the trolley.

The waste trolley may be formed with a rim projection which extends under a mop press discharge port, thereby to collect fluid expressed from the mop head by the mop press. The rim projection of the waste receptacle may nest with a corresponding recess in the clean receptacle so that the receptacles may sit adjacent one another.

A discharge port from the mopping press may be provided at one side of a bottom region of the mop press, so that liquid is discharged from one side of the mop press.

In another embodiment of the invention, the waste and clean receptacles may be located on the trolley in a front and rear (or fore/aft) arrangement so that the clean receptacle occupies a front region of the trolley, and the waste receptacle occupies a rear region of the trolley. In this embodiment the mop press may be provided with a discharge port that directs liquid expressed from a mop head generally rearwards into the waste receptacle. The discharge port may comprise a port formed at a rear end of a bottom region of the mop press.

A discharge port for the mopping press may be formed in an end cap attached to a bottom end region of the mop press. In this way a conventional mop press, or improved mop press of the type described in PCT/GB00/01688, may be adapted for use in the present invention, by modification by the attachment of a suitable end cap, such as a moulded plastics member.

Preferably the receptacles are removeably located on the trolley. Each receptacle may be removed independently of the other, for example for waste liquid discharge or clean liquid replenishment.

In order to improve the compactness of the design of the trolley and to maximise the efficiency of the mopping operation, it is preferred that the receptacle or "waste" bucket has a projection extending from its side adjacent the clean bucket which overlays part of, or otherwise is a fit with, the shape of the "clean" bucket. In this embodiment, the mop press is constructed and arranged to discharge water into this projection and/or the receptacle bucket directly. The "clean" bucket may be contoured accordingly to accommodate the overlaid portion. In one aspect of the invention, the clean bucket is shaped to define a recess in the surface to accommodate the projection. The recess may be closed to form part of the volume of the bucket. The projection should be of a depth designed to inter-engage with a corresponding contoured portion in the "clean" bucket and yet enable the "waste" bucket to be removed for emptying without the need to lift the bucket very substantially relative to the "clean" bucket while the latter remains in the carriage.

Experience has shown that best results are obtained with the capacity for the "clean" bucket at least 50% greater than that of the receptacle for the "waste"water expressed from the mop. In another embodiment of the present invention, the capacity of the "clean" bucket is at least twice that of the "waste" bucket. The selection of the relative sizing of the buckets is dependent, to some extent, on the nature of the floor being cleaned. It is clear that in relatively hot climates where there is relatively rapid evaporation of liquid from the floor during the cleaning part of the procedure, the drying operation will remove relatively little water and hence, relatively speaking, the size of the "waste" bucket relative to the size of the "clean" bucket can be reduced still further. Once the significance of the different sizes of bucket has been appreciated, it is a relatively simple matter for the person skilled in the art to determine the optimum size for the given circumstances and conditions in which the system is to be used.

By using the mopping trolley in accordance with the present invention, we have found that the efficiency of operation is improved very considerably. For a given size of trolley, a much greater amount of "clean" cleaning fluid may be accommodated within the "clean" bucket thereby reducing the number of occasions on which an operative has to return to a cleaning station to replenish supplies of cleaning fluid.

Following is a description by way of example only and with reference to the accompanying informal drawings, of methods of carrying the invention into effect.

In the drawings:—

Figure 1B:
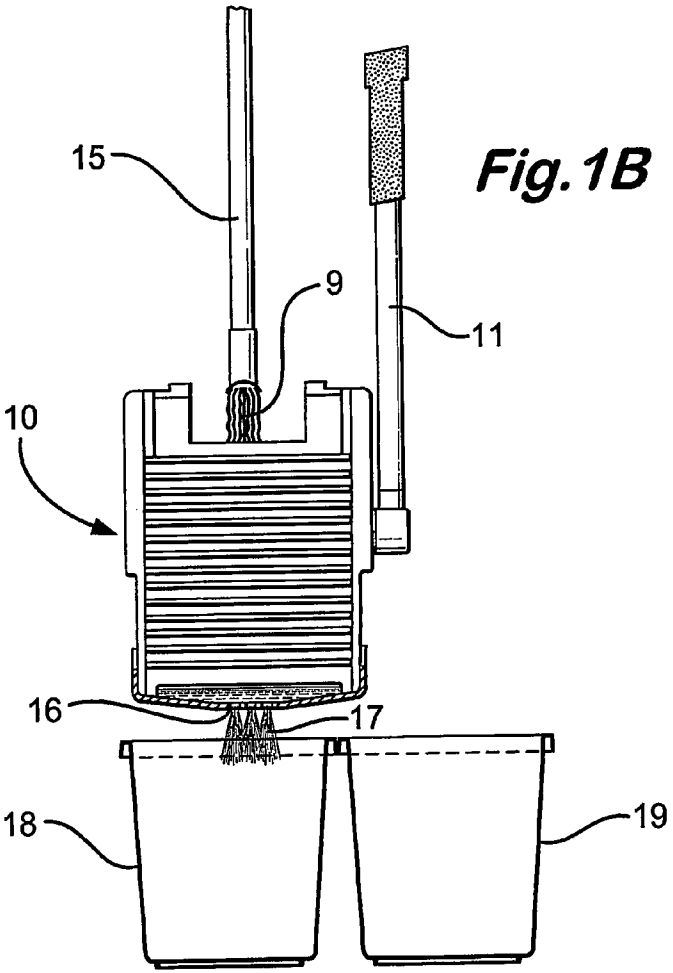
FIG. 1B is a front end view of the apparatus of FIG. 1A.
Figure 1A:
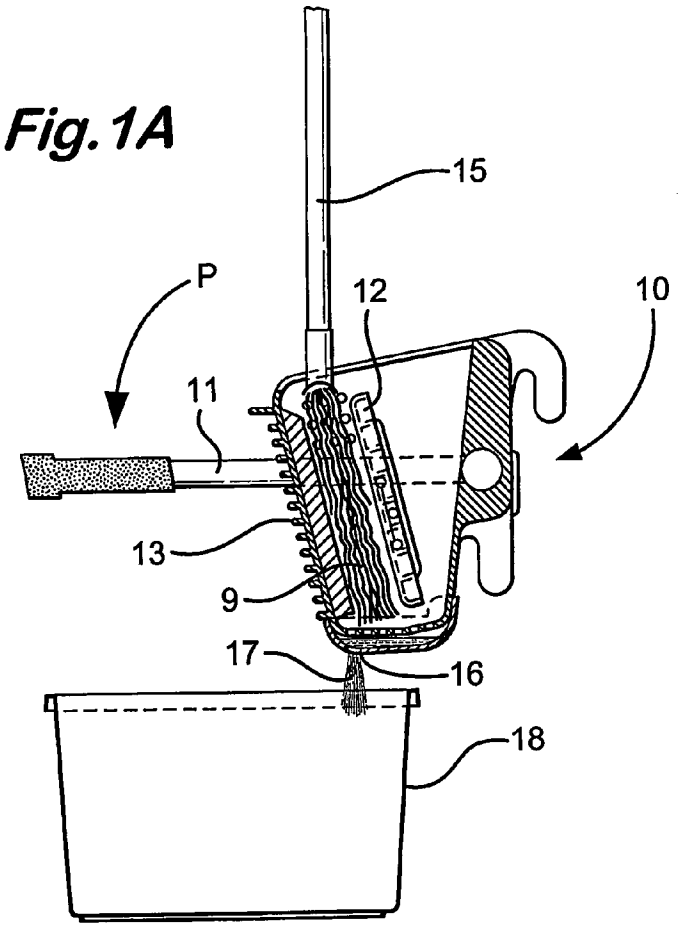
FIG. 1A is a side view of a mop press using a two-bucket arrangement.

Turning first to the drawings in accordance with prior art in FIG. 1A, a mop press indicated generally at 10 has an operating lever 11 the operation of which is adapted to bring pressure plates 12 and 13 together in order to squeeze a mop head 15 disposed therebetween. The application of, in this case downward, pressure P on lever 11 will serve to press mop head filaments 9 between plates 12 and 13 to express water from the mop head, which is discharged through an orifice 16 in the base of the receptacle defining the mop press 10. The water 17 expressed through orifice 16 is discharged into a waiting bucket 18. An identical bucket 19 (see FIG. 1B) is disposed in side-by-side relationship with bucket 18 and contains fresh cleaning fluid for application to the floor by the mop.

First Embodiment

Figure 2:
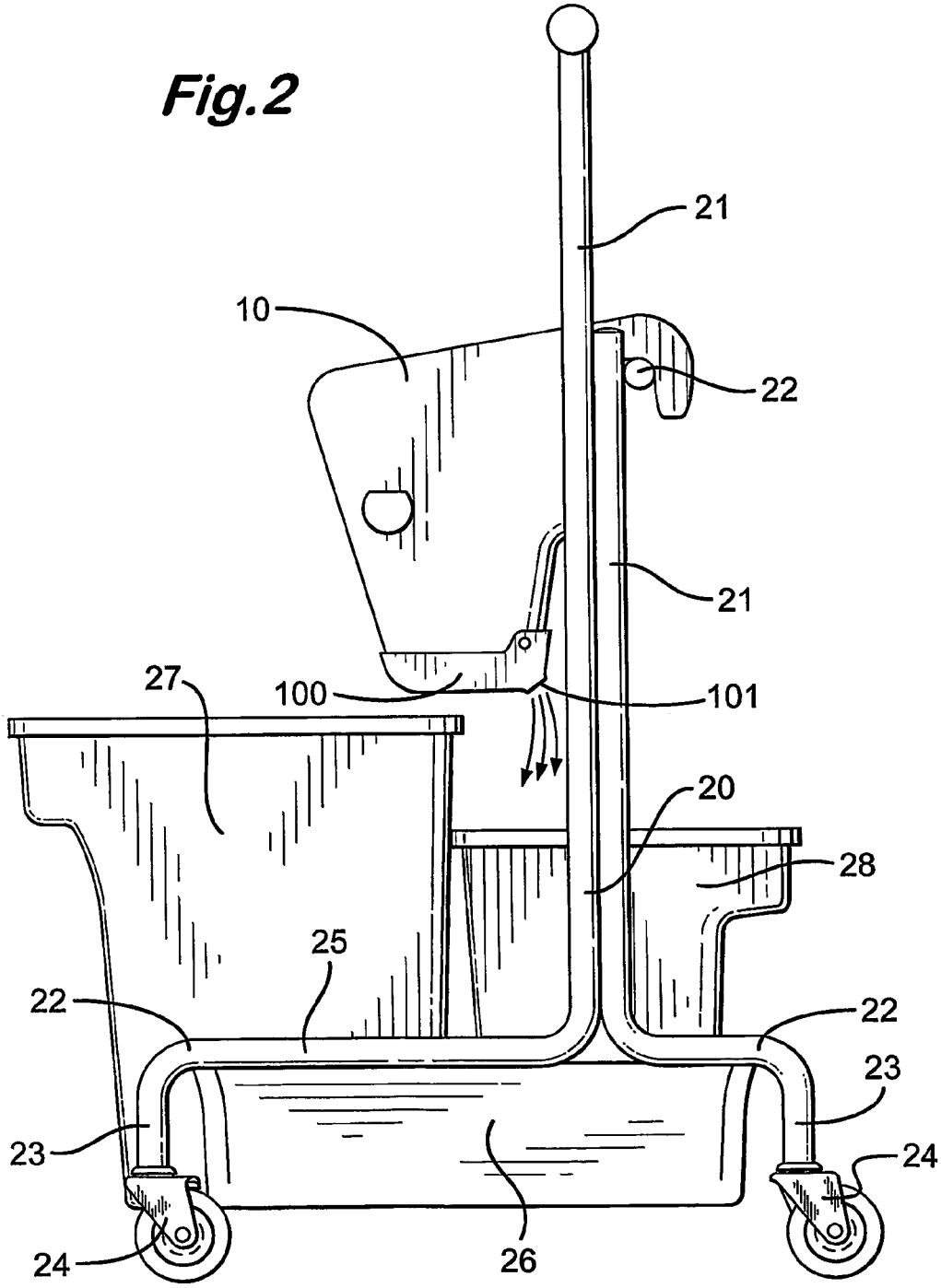
FIG. 2 is a side view of a mopping trolley in accordance with a first embodiment of the present invention.

In FIG. 2, the mopping trolley in accordance with the present invention comprises a generally tubular frame 20 having a central upstanding portion 21 and a horizontal portions 22 which serve to form a base frame together with corresponding portions on the far side (not visible).

The frame 20 has, towards each corner (near two visible), a downwardly projecting portion 23 which carries at its lower end a caster indicated generally at 24. A base frame member 25 of the trolley carries a plastic tray 26 adapted to accommodate a pair of buckets 27 and 28 respectively. The buckets are disposed fore-aft, so that bucket 27 is at a front end region of the trolley (i.e. working side), whereas the bucket 28 is at a rear end region of the trolley, The bucket 27 has approximately twice the capacity of bucket 28 and is adapted to be filled with cleaning fluid for application to the floor by dipping a mop head into the fluid in bucket 27, shaking the surplus from the mop head back into the bucket and then applying the cleaning fluid to a floor to be cleaned in even stokes to distribute cleaning fluid thereover. After distribution of cleaning fluid the mop head (not shown in FIG. 2, but as shown in FIG. 1) may be returned to a mop press 10. The mop press is hung from a transverse space frame member 22. The mop press is then used to express dirty fluid from the mop head in the usual manner. The mop press has the general configuration of that shown in FIG. 1. However, the mop press is provided with an end cap 100 formed of moulded plastics material. The end cap is formed with a draining port 101 at a lower rear end region thereof. This drains over and directly into the rear bucket 27, as shown in FIG. 2. In this way, waste water drains directly into the rear waste bucket, even though the mop press sits generally above and over the front clean bucket. The pressed mop may then be entered into the clean bucket for charging with cleaning fluid, and the cleaning process repeated.

Second Embodiment

Figure 3:
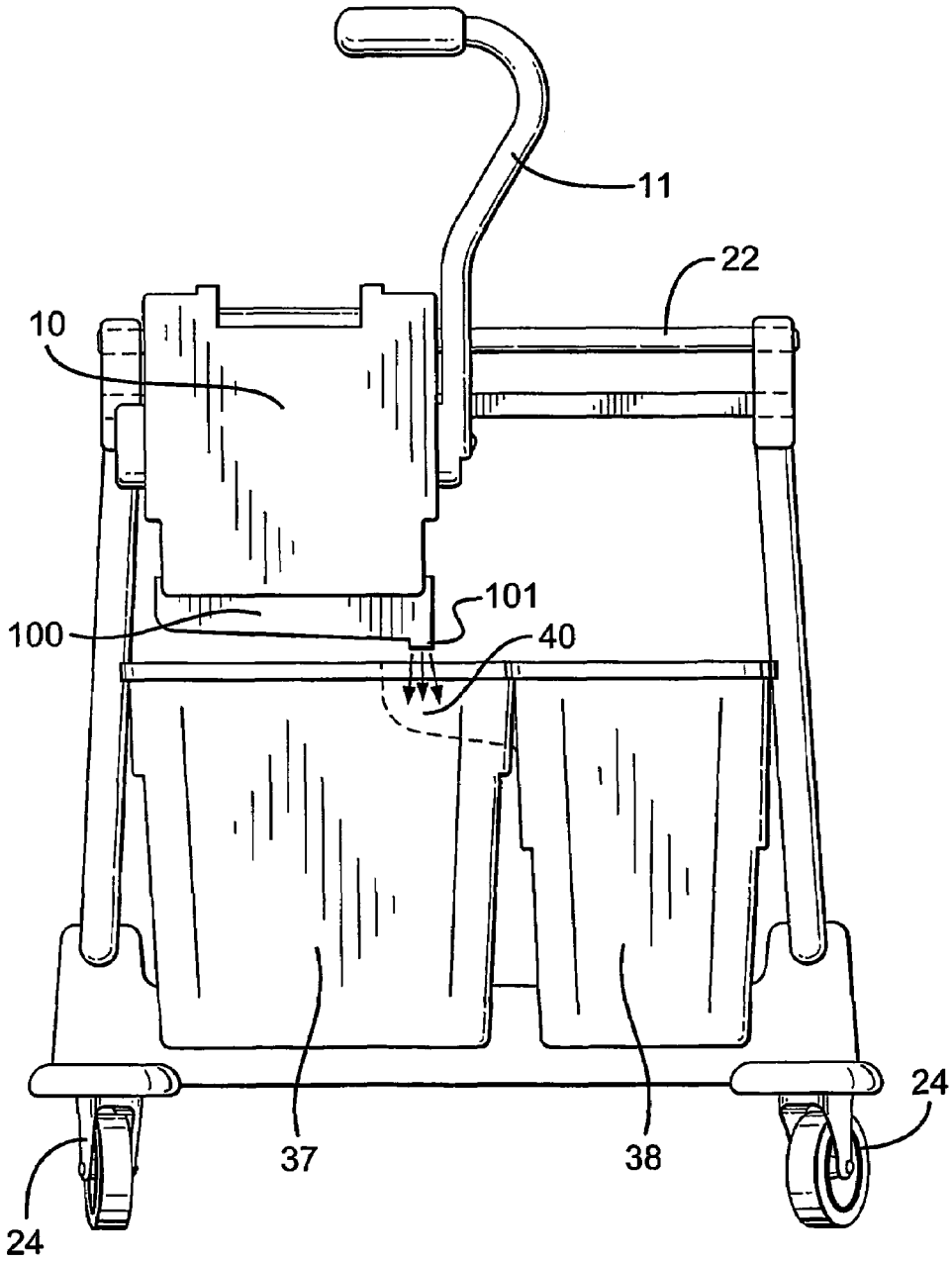
FIG. 3 is a front end view of a second embodiment of a mopping trolley in accordance with the present invention.
Figure 4:
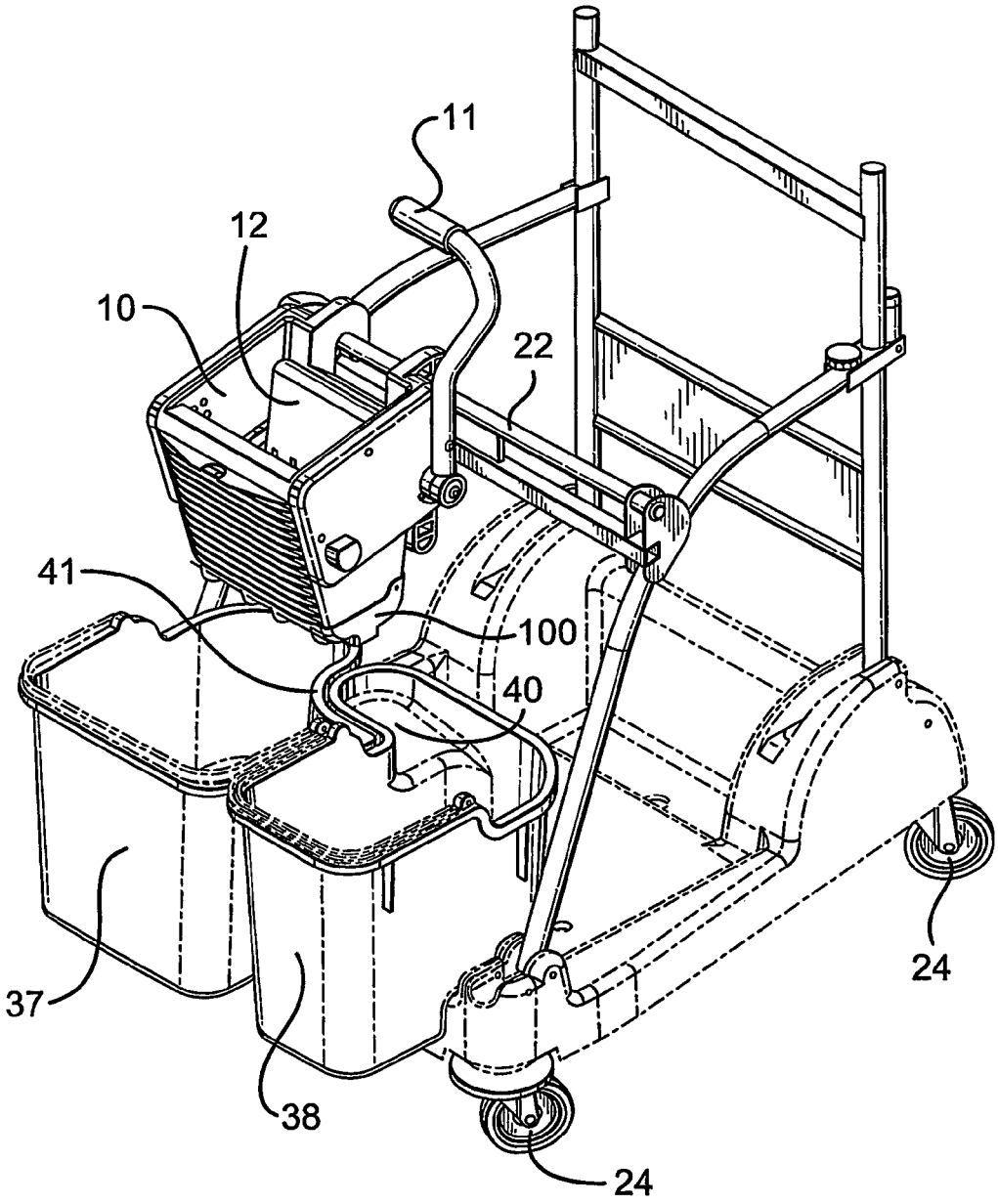
FIG. 4 is a perspective view from a front/side quarter of the mopping trolley of FIG. 3.

The embodiment shown in FIGS. 3 and 4 provides for a larger receptacle 37 and a smaller receptacle 38 to be accommodated in side-by-side relationship. Common features are numbered as per FIGS. 1 and 2. In this embodiment, the physical height of each receptacle is the same but the volumetric capacity of the receptacle 37 is approximately twice that of the "waste" receptacle or bucket 38. The upper part of bucket 38 is provided with a lateral projection 40 towards the rear of bucket 38 and on one side thereof, the projection 40 being of a sufficient depth that water can be discharged into it without significant splashing. The base of the projection is closed to guide the water entering projection 40 (dashed lines in FIG. 3) into the main body of volume of receptacle 38. The larger container 37, which contains clean water and cleaning agent solution, is correspondingly shaped at 41 (see FIG. 4) to accommodated the projection 40 from the adjacent bucket, so that the two buckets nest together. The wall of the bucket 37 is shaped over its whole depth to accommodate the projection 40 of bucket 38. In this way, the "clean" bucket 37 can be removed from tray 25 without disturbing bucket 38.

In an alternative embodiment (not shown), a portion of the body of bucket 37 may be expanded to extend under the overlay portion 40 of bucket 38 thereby increasing the volume of the "clean" bucket 37 still further.

In this second embodiment, the mop press has an alternatively configured end cap 100. The end cap has a bottom side that is inclined down towards the waste 30 bucket 38. A drain port 101 is formed at the side region of the end cap, so that the port drains onto the projection 40 of the waste bucket. In this way the mop press drains directly into the waste bucket 38, whilst being located above the clean water bucket 37. Thus during the mopping process a mop head (not shown) may be taken from the mop press and allowed to drop back into the cleaning fluid bucket 37 without moving the mop head laterally from the waste bucket (as would be the case for a prior art arrangement in which the mop head was pressed over the waste bucket, as shown in FIG. 1B). This makes the mopping pressing and charging actions considerably more convenient for the operator.

The relatively shallow depth of the overlay portion 40 means that the bucket 38 can be removed easily, with bucket 37 remaining in place without requiring an operative to life a heavy bucket full of water to a considerable height.

In both above embodiments, the relatively large size of the cleaning bucket ensures that few trips to water replenishment stations are necessary, thereby increasing the operative's effective cleaning time. The combination of bucket size differential, location of the mop press over the cleaning bucket and draining port orientation over the waste bucket provides enhanced mopping efficiency.

The invention claimed is:

1. A mopping trolley comprising:

a) a carriage capable of translational movement over a surface;

b) a mop press assembly carried by said carriage for expressing liquid from a mop head inserted into the press, wherein said mop press assembly includes a discharge port; and c) at least two liquid receptacles, wherein one of said liquid receptacles is a waste receptacle arranged to receive waste liquid expressed from the mop head, and one of said liquid receptacles is a clean receptacle for providing a source of clean liquid for use in mopping, wherein the clean receptacle is located under the mop press and the waste receptacle includes a portion positioned below the discharge port of the mop press, whereby liquid expressed from the mop head is diverted via the discharge port into said waste receptacle portion rather than falling into the clean receptacle.

2. A mopping trolley as claimed in claim 1 wherein the clean receptacle has a greater volumetric capacity than the waste receptacle.

3. A mopping trolley as claimed in claim 2 wherein the clean receptacle has a capacity that is at least 40% greater than the waste receptacle.

4. A mopping trolley as claimed in claim 3 wherein the clean receptacle has a capacity that is at least 50% greater than the waste receptacle.

5. A mopping trolley as claimed in claim 1 wherein the waste and clean receptacles are located on the trolley in a side-by-side arrangement so that the receptacles occupy a front region of the trolley.

6. A mopping trolley as claimed in claim 1 wherein said discharge port is provided at one side of a bottom region of the mop press assembly, so that liquid is discharged from one side of the mop press.

7. A mopping trolley as claimed in claim 1 wherein the waste and clean receptacles are located on the trolley in a front and rear arrangement so that the clean receptacle occupies a front region of the trolley, and the waste receptacle occupies a rear region of the trolley.

8. A mopping trolley as claimed in claim 7 wherein said discharge port directs liquid expressed from a mop head generally rearwards into the waste receptacle.

9. A mopping trolley as claimed in claim 8 wherein the discharge port comprises a port formed at a rear end of a bottom region of the mop press.

10. A mopping trolley as claimed in claim 1 wherein said discharge port is formed in an end cap attached to a bottom end region of the mop press assembly.

11. A mopping trolley as claimed in claim 1 wherein the receptacles are removeably located on the trolley and each receptacle independently of the other.

12. A mopping trolley comprising carriage means capable of translational movement over a surface, a mop press assembly carried by said carriage means for expressing liquid from a mop head inserted into the press and at least two liquid receptacles, wherein a waste receptacle is arranged to receive waste liquid expressed from the mop head, and a clean receptacle is for providing a source of clean liquid for use in mopping, wherein the clean receptacle is located under the mop press and the waste receptacle is in fluid communication with a discharge port from the mop press, whereby liquid expressed from the mop head is conveyed to the waste receptacle; wherein the waste and clean receptacles are located on the trolley in a side-by-side arrangement so that the receptacles occupy a front region of the trolley; and further wherein the waste trolley is formed with a rim projection which extends under a mop press discharge port, thereby to collect fluid expressed from the mop head by the mop press.

13. A mopping trolley as claimed in claim 12 wherein the rim projection of the waste receptacle nests with a corresponding recess in the clean receptacle so that the receptacles may sit in close proximity.

14. A mopping trolley comprising a carriage capable of translational movement over a surface, a mop press assembly carried by said carriage for expressing liquid from a mop head inserted into the press and at least two liquid receptacles, wherein a waste receptacle is arranged to receive waste liquid expressed from the mop head, and a clean receptacle is for providing a source of clean liquid for use in mopping, wherein the clean receptacle is located under the mop press and the waste receptacle is in fluid communication with a discharge port from the mop press, whereby liquid expressed from the mop head is is diverted via the discharge port into said waste receptacle rather than falling into the clean receptacle.

15. A mopping trolley as claimed in claim 14 wherein the clean receptacle has a greater volumetric capacity than the waste receptacle.

16. A mopping trolley as claimed in claim 15 wherein the clean receptacle has a capacity that is at least 40% greater than the waste receptacle.

17. A mopping trolley comprising a carriage capable of translational movement over a surface, a mop press assembly carried by said carriage for expressing liquid from a mop head inserted into the press and at least two liquid receptacles, wherein a waste receptacle is arranged to receive waste liquid expressed from the mop head, and a clean receptacle is for providing a source of clean liquid for use in mopping, wherein the clean receptacle is located directly under the mop press and the waste receptacle is in fluid communication with a diverting discharge port from the mop press, whereby liquid expressed from the mop head is is diverted via the discharge port into said waste receptacle rather than falling into the clean receptacle.

18. A mopping trolley as claimed in claim 17 wherein the clean receptacle has a greater volumetric capacity than the waste receptacle.

19. A mopping trolley as claimed in claim 18 wherein the clean receptacle has a capacity that is at least 40% greater than the waste receptacle.

20. A mopping trolley as claimed in claim 19 wherein the clean receptacle has a capacity that is at least 50% greater than the waste receptacle.

* * * * *